United States Patent [19]

Putman et al.

[11] Patent Number: 4,477,792

[45] Date of Patent: Oct. 16, 1984

[54] MODULAR POWER SYSTEM REACTOR

[75] Inventors: Thomas H. Putman, Penn Hills, Pa.; Andrew S. Sweetana, Jr., Bloomington; Frederick J. Brown, Ellettsville, both of Ind.

[73] Assignee: Westinghouse Electric Corp., Pittsburgh, Pa.

[21] Appl. No.: 344,258

[22] Filed: Jan. 29, 1982

[51] Int. Cl.[3] ..... H01F 27/28

[52] U.S. Cl. ..... 336/180; 336/185; 336/207; 336/232

[58] Field of Search ..... 336/232, 207, 185, 180, 336/60

[56] References Cited

U.S. PATENT DOCUMENTS

| | | | |
|---|---|---|---|
| 1,017,348 | 2/1912 | Murray et al. | 336/232 X |
| 1,253,275 | 1/1918 | Peters | 336/232 X |
| 1,466,253 | 8/1923 | Skinner | 336/232 X |
| 1,554,250 | 9/1925 | Woodrow | 336/185 |
| 1,579,883 | 4/1926 | Murray | 336/207 X |
| 1,745,812 | 2/1930 | Ready | 336/180 X |
| 1,813,994 | 7/1931 | George | 336/232 X |
| 1,955,313 | 4/1934 | Sauer | 336/185 X |
| 1,984,996 | 12/1934 | Sauer | 336/185 X |
| 2,082,121 | 6/1937 | Rypinski | 336/180 X |
| 2,646,535 | 7/1953 | Coggeshall | 336/208 X |
| 2,892,168 | 6/1959 | Seidel et al. | 336/207 |
| 2,959,754 | 11/1960 | MacKinnon | 336/185 |
| 3,225,319 | 12/1965 | Trench | 336/180 |
| 3,264,590 | 8/1966 | Trench | 336/60 |
| 3,362,000 | 1/1968 | Sealey et al. | 336/58 |
| 3,362,001 | 1/1968 | Wishman et al. | 336/60 |
| 3,621,429 | 11/1971 | Benke | 336/207 X |
| 3,696,315 | 10/1972 | Riggins | 336/207 |
| 4,308,512 | 12/1981 | Capecchiacci et al. | 336/207 X |

*Primary Examiner*—Thomas J. Kozma
*Attorney, Agent, or Firm*—G. H. Telfer

[57] ABSTRACT

The present invention discloses a modular reactor that increases the inductance per axial length by winding a conductor circumferentially about a central axis in a manner which results in radially extending columns which are sequentially wound in alternating radial order. The modules are constructed to allow them to be combined in either radial or axial juxtaposition and electrically connected either in series or in parallel.

4 Claims, 9 Drawing Figures

FIG. 1
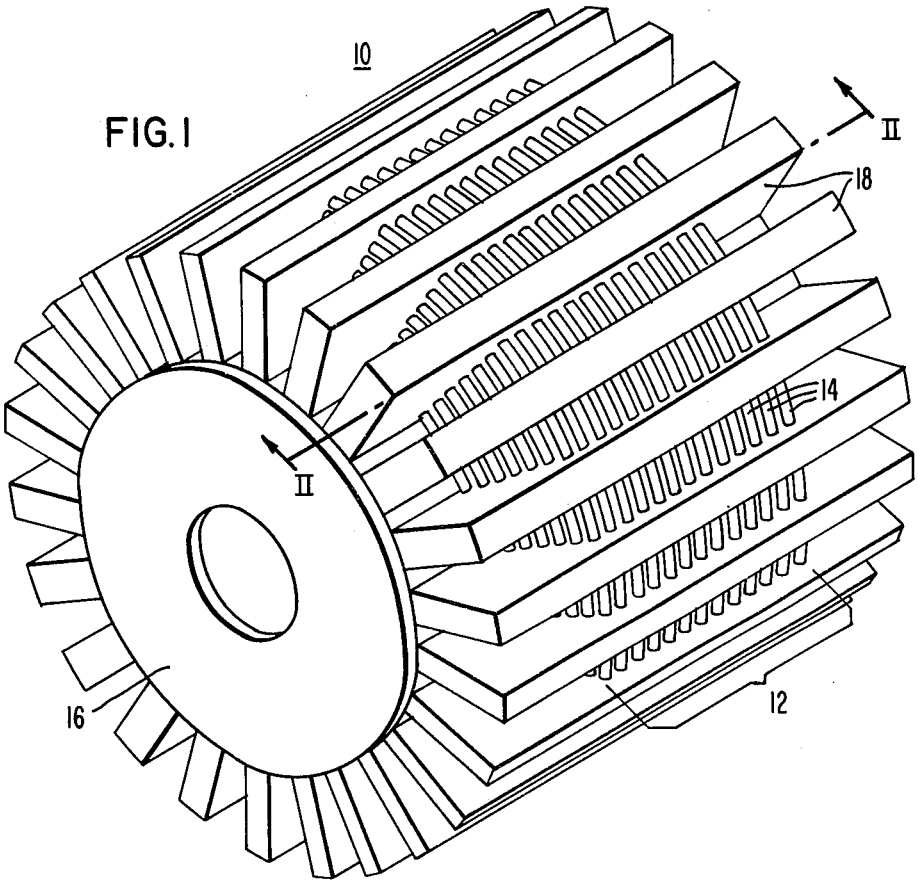
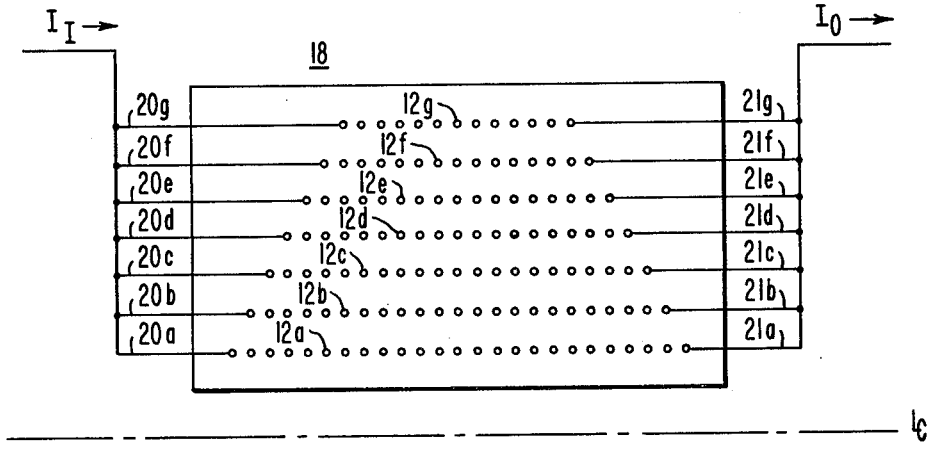
FIG. 2

MODULAR POWER SYSTEM REACTOR

BACKGROUND AND SUMMARY OF THE INVENTION

The present invention relates to reactors for electrical power distribution and transmission systems and, in particular, to a modular construction of a reactor which has a high inductance and a high current carrying capacity.

Shunt reactors are used in conjunction with high voltage, alternating current power transmission and distribution lines to compensate for line charging current and to allow the charge remaining on the line to bleed to ground when the line is opened. Usually, the shunt reactor has an air or nonmagnetic material core or a laminated steel core with air gaps within the coil and the assembly is immersed in oil inside a tank. A shunt reactor construction is disclosed in U.S. Pat. No. 3,362,000 issued to Sealey et al. on Jan. 2, 1968 which discloses a reactor which has an axially short coil and magnetically permeable yoke means adjacent the ends of the coil which straighten the magnetic flux lines within the coil and decrease the length of the average flux path so that substantially all of the reluctance of the magnetic flux path is internal of the coil. A related patent, U.S. Pat. No. 3,362,001 issued to Wishman et al. on Jan. 2, 1968, discloses a shunt reactor wherein the ratio of coil radius to coil axial length is substantially increased in comparison to known reactors of the same voltage rating, thus resulting in an increase in magnetic flux density and a corresponding increase in inductance for a given physical size of reactor. It discloses a shunt reactor wherein the axial spacing between adjacent pancake windings of the reactor coil is substantially reduced in comparison to previously known reactor coils of the same voltage rating, thus permitting reduction in the axial length of the reactor coil and resulting in substantial reduction in size and weight for a given KVA rating in comparison to known reactors at the time. U.S. Pat. No. 3,991,394 issued to Barnwell et al. on Nov. 9, 1976 discloses a power line inductor having a plurality of coaxial coils. The coaxial coils are formed by rectangular conductors wound side by side in a single layer with a selected number of turns. U.S. Pat. No. 2,082,121 issued to Rypinski on June 1, 1937 discloses a time-controlled reactor. It further provides a circuit arrangement for the reactor by which the electromagnetic properties of the reactor may be controlled in accordance with a given time period. It provides a reactor with a plural winding electromagnetic system in which the magnetic effect is controlled by a differential change in resistance in the electromagnetic windings in accordance with a predetermined time cycle. U.S. Pat. No. 3,902,147 issued to Trench on Aug. 26, 1975 discloses an air core duplex reactor consisting of one, two or more sets of two rigid cylindrical assemblies disposed in concentric, radially spaced relation. All of its coils are electrically connected in parallel at one end and have individual connections for the respective sets of coils at the opposite end, one set of coils being interleaved with the other and each coil consisting of a rigid, longitudinally extending sleeve member having a coil wound on a portion of the length thereof extending from adjacent the parallel connected end in a direction toward the opposite end.

One of the major requirements in building high current reactors is the provision of an adequate conductor cross section to carry the required current without overheating. Utilizing a conductor with a large cross sectional area is not a viable solution because such conductors are generally very difficult to handle in the manufacturing process because of their inherent stiffness. Also, with large cross section conductors, losses caused by skin effect and exposure to alternating magnetic fields are increased. Therefore, it is necessary to connect a multiplicity of smaller cables electrically in parallel and provide a means to balance the current in these various parallel paths. An example of this is the design of line trap reactors where several coaxial single-layer coils are electrically connected in parallel with the layer currents being balanced by careful control of the number of turns in each layer. An alternate embodiment of this method utilizes stranded cable as the basic conductor.

The present techniques which utilize parallel layers inevitably lead to low inductance reactors although very high currents can be obtained. For stranded aluminum cable with an area approximately equal to 600 MCM (thousand circular mills) and current rating of 2000 to 3000 amperes, it appears that 1.5 millihenries is about the maximum inductance that can be obtained with the single layer, parallel-coil type of construction. The reason for this is that reactors with larger inductance require more turns per layer and a larger diameter for each layer. This leads to uneconomical reactor proportions when carried to the extreme.

The present invention provides a means for building both high inductance and high current capacity reactors by utilizing a modular design. Since the energy storage capacitor of a reactor is a function of both its inductance and current as defined by $E=\frac{1}{2}LI^2$, it should be apparent that, by increasing both inductance L, and current flow I, significant energy storage increases can be obtained. In a reactor made in accordance with the present invention, the required current rating is obtained by connecting several modules electrically in parallel, each of which has the same current rating. The current rating of a particular module is determined by the size of cable which is used. For example, rubber coated 500 MCM aluminum cable may be used which can carry about 250 amperes when wound in a reactor. A 1000 ampere reactor utilizing this conductor would require four modules connected electrically in parallel. To reduce the physical size of the overall reactor, maximum advantage can be taken of the mutual inductance between modules. In a reactor made in accordance with the present invention, all modules are coaxial and may be oriented relative to each other in two distinct ways, axially or radially juxtaposed. In the axially juxtaposed configuration, the generally cylindrical modules of the present invention each have generally identical inside and outside diameters and are positioned in axial relation along the same center line. In this configuration the length of the modules need not necessarily be identical and they will not have the identical number of turns. When the modules are axially associated in this way and the same current is passed through each module, by connecting them electrically in series, the flux linkages with any particular module will depend not only upon its own length and turns but also upon the length and turns of its associated modules comprising the composite reactor. By a judicious choice of module lengths and turns, it is possible to not only obtain identical flux linkages in all the modules, but to preselect its value. The axially juxtaposed configuration also enables the modules to be connected electrically in parallel, with the currents in each module therefore being identical since each module has exactly the same flux linkages.

As mentioned above the modules may also be associated in radial juxtaposition. In this configuration, each module generally has the same length, but different diametric dimensions and number of turns. The modules are both coaxial and concentric. The inside and outside diameters of each module are selected to permit the modules to be associated in a radial relation. As in the case of the axially juxtaposed reactor, described above, the modules must be constructed in such a way that they will be carrying nearly identical currents. Also as in the axially juxtaposed modular reaction described above, the modules may be connected electrically either in series or in parallel.

It is, therefore, an object of the present invention to provide a modular reactor that has a high inductance and a high current carrying capacity, which utilizes modules which may be disposed in a radial or an axial association and may be connected either in series or in parallel.

BRIEF DESCRIPTION OF THE DRAWINGS

The present invention will be more fully understood by reading the description of the preferred embodiment in conjunction with the Figures, in which:

FIG. 1 illustrates a reactor constructed under presently known techniques;

FIG. 2 is a sectional view of a support member of the reactor shown in FIG. 1;

DESCRIPTION OF THE PREFERRED EMBODIMENT

Figure 3:
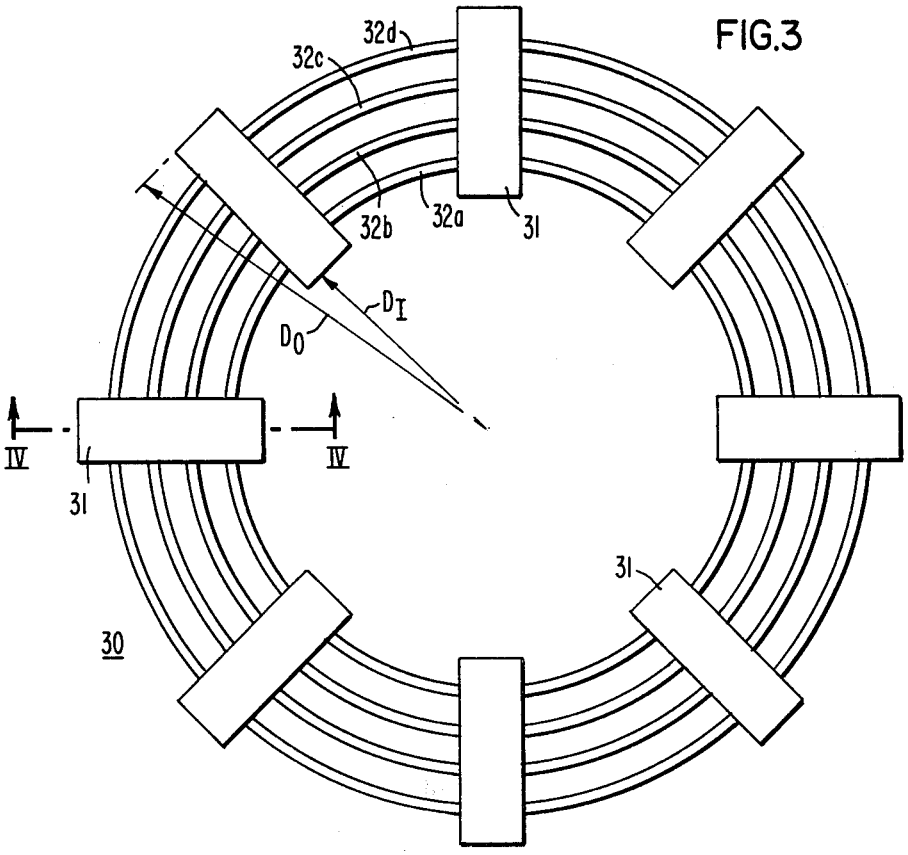
FIG. 3 shows a reactor module made in accordance with the present invention.

The present invention relates generally to electrical reactors and, specifically, to a modular reactor having high inductance characteristics and a high current capacity.

Typically, reactors are manufactured by helically winding a conductive cable around a suitable cylindrical framework as illustrated in FIG. 1. The reactor 10 comprises a plurality of rows 12 of conductors 14 wound around a framework 16 in an axially progressing sequence. After the radially innermost row is complete, another row is wound around it. The cable 14, as associated with a row 12, is electrically insulated from adjacent cables and the rows 12 are connected electrically in parallel with each other. To support the conductors 14, the framework may have a plurality of radially extending insulative members 18 which extend the axial length of the reactor 10.

A cross section of one of these insulative support members 18 is shown in FIG. 2. For illustrative purposes, seven rows of conductors (i.e., 12*a* through 12*g*) are shown passing through the support 18. Each row comprises a single conductive cable helically wound about the center line of the reactor as shown. It should be apparent that a cable wound about a reactor in this manner has two termini disposed at opposite axial ends of the reactor.

Also in FIG. 2, multiple connection means are schematically depicted whereby each row can be connected electrically in parallel with other rows. For example, one axial terminus of row 12*a* is connected in electrical communication with an incoming current $I_I$ transmission line by connective means 20*a* while its other axial terminus is connected to the outgoing current $I_O$ transmission line by connective means 21*a*. As can be seen in FIG. 2, all of the conductor rows (i.e., 12*a* through 12*g*) are similarly connected by connective means (i.e., 20*a* through 20*g* and 21*a* through 21*g*) to form an electrical circuit in which the rows of conductors are connected electrically in parallel with the total reactor being electrically in series with the transmission line.

These parallel rows of conductors (i.e., 12*a* through 12*g*) are designed to carry nearly equal currents. In this example, each row would carry one seventh of the total current $I_I$ or $I_O$. In order to achieve this current balance between rows, the number of turns in the radially outer rows is reduced because the inherently higher resistance and self induction of these outer rows would otherwise reduce the current flowing therein and cause a deleterious current imbalance.

It should be understood that, in a reactor of the type illustrated in FIGS. 1 or 2, the designer is faced with interactive design considerations. For example, the cross-sectional area and material characteristics of the conductor cable (reference numeral 14 in FIG. 1) determine its current carrying capacity. Along with the current criterion of the reactor (reference numeral 10 in FIG. 1) this characteristic determines the required number of parallel electrical paths, or rows 12, that must be incorporated in the reactor.

Similarly, the inductance of the reactor is a function of the number of turns of the conductor cable about the central axis of the reactor. This relationship of the number of turns to the reactor's inductance necessitates, for high inductance, a larger axial length of the reactor. It should be apparent that, although a reactor of extremely large radial and axial dimensions is possible to construct, building a reactor that has both a high inductance and a high current carrying capacity would necessitate a very large and cumbersome structure that would be uneconomical to manufacture and difficult to ship and install in its field location of application.

The present invention uses a modular concept in which reactors are constructed by combining two or more modules in either axial or radial association and connecting them in either series or parallel electrical communication. Such a module is shown in FIG. 3. The module 30 comprises a conductor which is circumferentially wound in a generally cylindrical configuration. In the view of FIG. 3, the conductor is shown to form four rows (reference numerals 32*a*, 32*b*, 32*c* and 32*d*) which are supported by a plurality of radially extending insulative structures 31. These structures 31 are sized to support the conductor within the radially dimensional limits shown as $D_I$ and $D_O$ which are inside and outside diameters, respectively, of the resultant cylindrical module 30.

Figure 4:
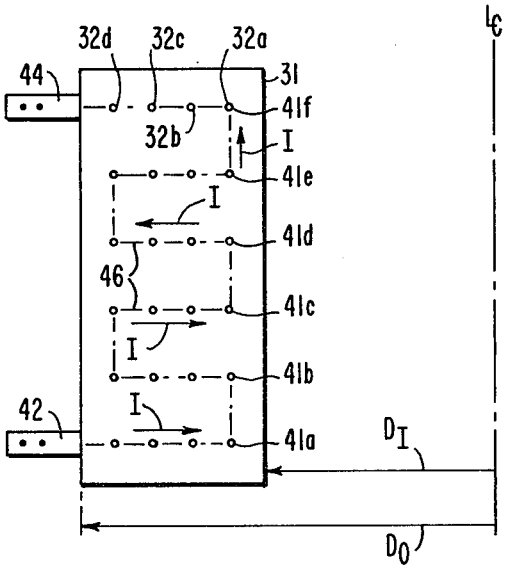
FIG. 4 is a section view of a support member of the module shown in FIG. 3.

Sectional view IV—IV of FIG. 3 is illustrated in greater detail in FIG. 4. The order in which the conductor is wound about the module's central axis distinguishes it from the reactor described above and depicted in FIGS. 1 and 2. As can be seen in the sectional view of FIG. 4, the sequence in which the conductor is wound creates a plurality of radially extending columns, 41*a* through 41*f*, in which adjacent columns are wound in alternating radial order. In other words, the single turn of the conductor shown at the intersection of row 32*d* and column 41*a* is wound first followed by the turn shown at the intersection of row 32*c* and column 41*a*, and so on, with the last turn of the module being wound at the intersection of row 32*d* and column 41*f*. This sequence is shown by the dashed line 46 and the current directional arrow I. It should be understood that the arrow I depicts the sequence of current flow through the sectional views of the conductor turns shown in FIG. 4 and not the actual current path. Between any two sequential turn sections, the current must travel through the entire turn which extends circumferentially around the central axis of the module 30. It should be understood that in situations when it becomes advantageous to reduce the number of turns in a particular module, one or more of the plurality of turn positions shown in FIG. 4 may be intentionally omitted. Of course, the remaining turns would be continuously wound and electrical communication between the wound turns would thus be maintained.

The module 30, therefore, comprises a continuous conductor cable with two termini. A module 30 made in accordance with the present invention has means for electrically connecting external conductors to each of these termini. This can be accomplished with generally rigid conductive tabs or blades, 42 and 44, which are each in electrical communication with a preselected terminus of the conductor cable. These tabs, 42 and 44, are shown to be extending radially outward in FIG. 4 but it should be understood that they may be positioned otherwise within the scope of the present invention, depending upon the intended structural configuration of the modular reactor to be constructed. As in FIG. 3, the insulative support structure 31 is shown in FIG. 4 to be dimensioned to support the plurality of conductor turns within the radial dimension, $D_I$ and $D_O$.

It should be apparent from FIG. 4 and the above discussion that the sequence and configuration of the turns of module 30 obtain significant electrical and physical advantages. Compared to present methods of reactor construction, the present invention results in many more electrically serial turns in a given axial length than the reactor shown in FIG. 2.

The minimum distance between adjacent conductors is a function of, among other things, the voltage potential between the adjacent conductors and heat transfer considerations. It should be apparent that, for any given minimum distance, the present invention provides a means for winding more turns in a given axial distance than the former method described above. Comparing the winding pattern of a single row of conductors as shown in FIG. 2 with the single conductor of the present invention as illustrated in FIG. 4 makes this characteristic apparent. Of course, it should be understood that the number of rows and columns shown in FIG. 4 are merely exemplary and used for illustrative purposes, whereas a module made in accordance with the present invention can comprise any practical number of rows and columns.

Figure 5:
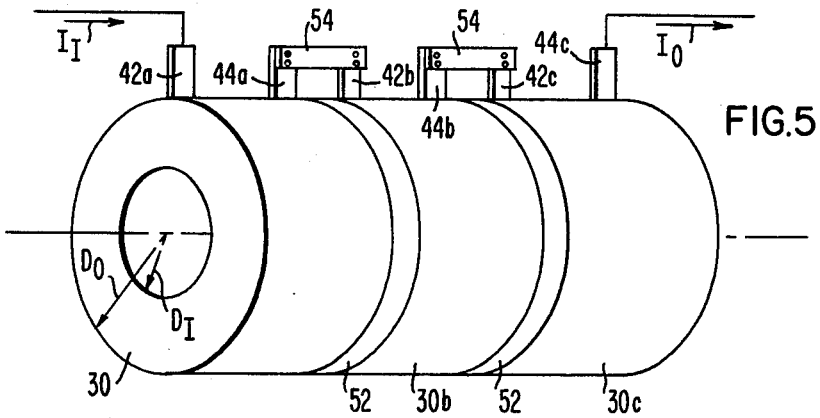
FIG. 5 shows an exemplary configuration of three modules axially juxtaposed and connected electrically in series.

In FIG. 5 a possible combination of modules is schematically illustrated using annular cylinders (reference numerals 30, 30*b* and 30*c*) to represent the modules of the present invention. In this configuration, referred to herein as axial juxtaposition, the modules each have generally identical inside and outside diameters, $D_I$ and $D_O$, respectively. They are also shown connected electrically in series so that the incoming current $I_I$ passes sequentially through each module before flowing from the last module, as $I_O$, and back to an associated transmission line. It should be understood that this same physical configuration (i.e., axial juxtaposition) can easily be electrically connected in parallel by providing electrical connections between tabs 42*a*, 42*b* and 42*c* and by providing electrical connections between tabs 44*a*, 44*b* and 44*c* instead of the intertab connections shown in the Figure.

It should be apparent, however, to one skilled in the art that each module can be wound in either the clockwise or counterclockwise circumferential direction. When the modules of the present invention are configured in the axially juxtaposed configuration as shown in FIG. 5 and connected electrically in parallel as described above, adjacent modules must be wound in opposite circumferential directions. For example, referring to FIG. 5, modules 30 and 30*c* would be wound in a clockwise direction with module 30*b* wound in a counterclockwise direction in the case where the three axially juxtaposed modules are connected electrically in parallel. The purpose of this is twofold. First, each module's contribution to the composite magnetic field will be additive and secondly, adjacent connective tabs (e.g. tabs 44*a* and 42*b*) will be at equal voltage potential instead of having the line voltage potential between them which would require a substantial insulative means to prevent electrical arcing between adjacent tabs. This characteristic will be more fully described below.

Generally, the modules are positioned in such a way as to provide a clearance 52 therebetween for mechanical bracing of the modules although this is not absolutely necessary within the scope of the present invention. The clearance 52 also provides the capability to more precisely determine the inductance of the composite reactor. By altering the distance between modules, the flux linkages therebetween can be modified to finely tune the reactor's inductance to a predetermined value.

Figure 6:
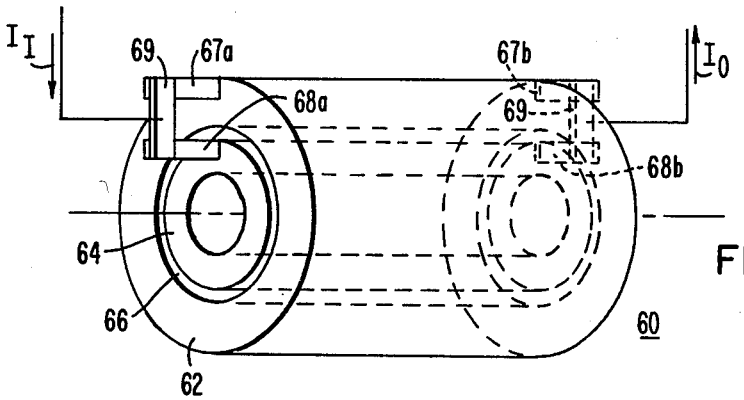
FIG. 6 illustrates an exemplary configuration of two modules configured in radial juxtaposition and electrically connected in parallel.

If the modules are constructed with appropriately dimensioned inside and outside diameters, radial juxtaposition as shown in FIG. 6 is possible. The outer module 62 is constructed so that its inside diameter is large enough to permit a smaller inner module 64 to be disposed therein with a suitable clearance 66 therebetween. The two radially juxtaposed modules are both coaxial and concentric about their common center line. Module 62 is equipped with axially extending tabs 67*a* and 67*b* which extend in mutually opposite directions while module 64 has similarly extending tabs 68*a*and 68*b*. By connecting tabs 67*a* and 68*a* together with an intertab connector 69 and providing electrical communication between them and an incoming transmission line while similarly connecting tabs 67*b* and 68*b* together to an outgoing transmission line, the component reactor 60 is in series with the transmission line while the modules, 62 and 64, are connected in parallel. Of course, by appropriate electrical connections these two radially juxtaposed modules can also be connected in series.

Again, it should be noted that it is important to assure that the circumferential direction of winding of each module is carefully chosen. When, radially juxtaposed modules are used, their electrically serial connection requires that adjacent modules be oppositely wound for the same reasons given above for oppositely winding adjacent modules which are axially juxtaposed and connected in parallel.

Figure 7:
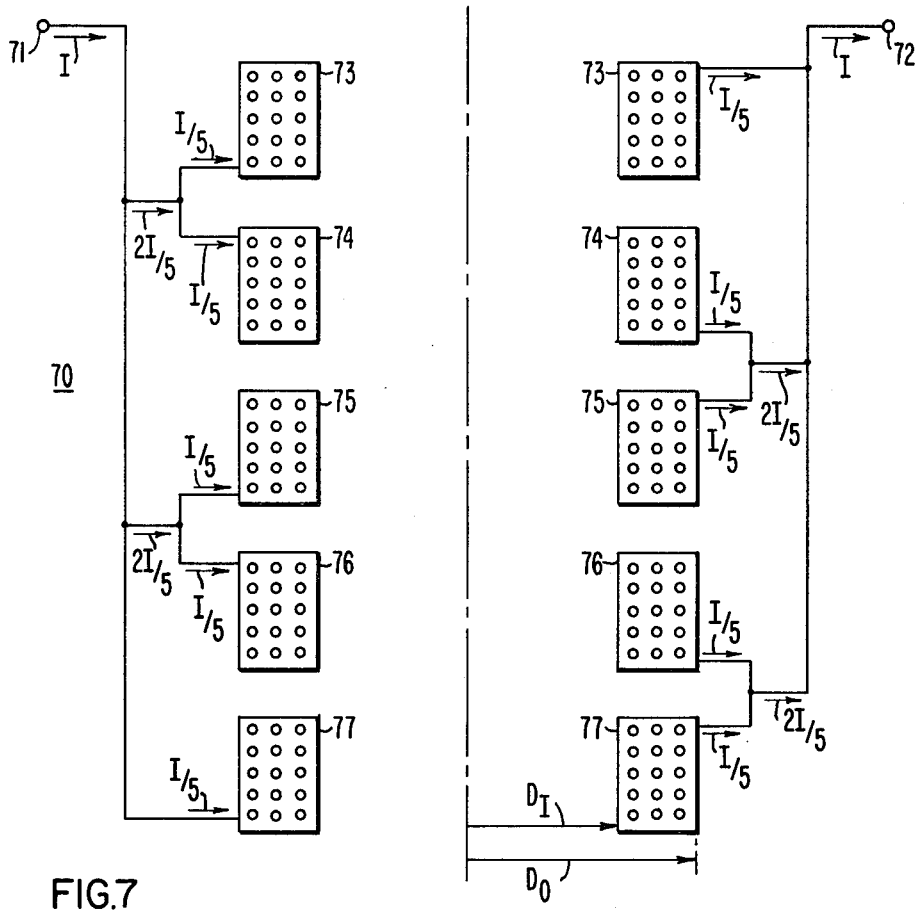
FIG. 7 shows a sectional view of five modules disposed in axial juxtaposition and connected electrically in parallel.

As a further illustration of the varied applications possible with the modular concept of the present invention, FIG. 7 shows five modules which are axially juxtaposed and electrically connected in parallel. The current directional arrows demonstrate the fractional currents flowing through each module. This axially juxtaposed configuration, as described above, utilizes modules (reference numerals 73, 74, 75, 76 and 77) which have essentially identical inside and outside diameters, $D_I$ and $D_O$, respectively. The composite reactor 70 would be appropriately connected in series between points 71 and 72 of a transmission line. As described above, modules 73, 75 and 77 would be circumferentially wound in an opposite direction than modules 74 and 76 since they are all axially juxtaposed and connected electrically in parallel.

Figure 8:
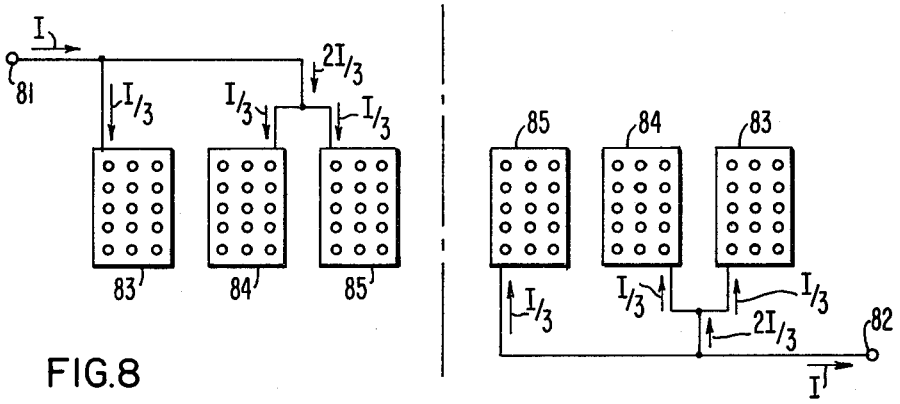
FIG. 8 illustrates three modules radially juxtaposed and connected electrically in parallel.

In FIG. 8, a reactor 80 is shown which comprises three radially juxtaposed modules 83, 84 and 85 connected in parallel. The composite reactor 80 is then connected in series between points 81 and 82 of a transmission line. The current directional arrows illustrate the fractional parts of the transmitted current flowing through each of the modules.

Since the modules 83, 84 and 85 are radially juxtaposed and connected electrically in parallel, they should all be wound circumferentially in the same direction (e.g. either clockwise or counterclockwise).

Figure 9:
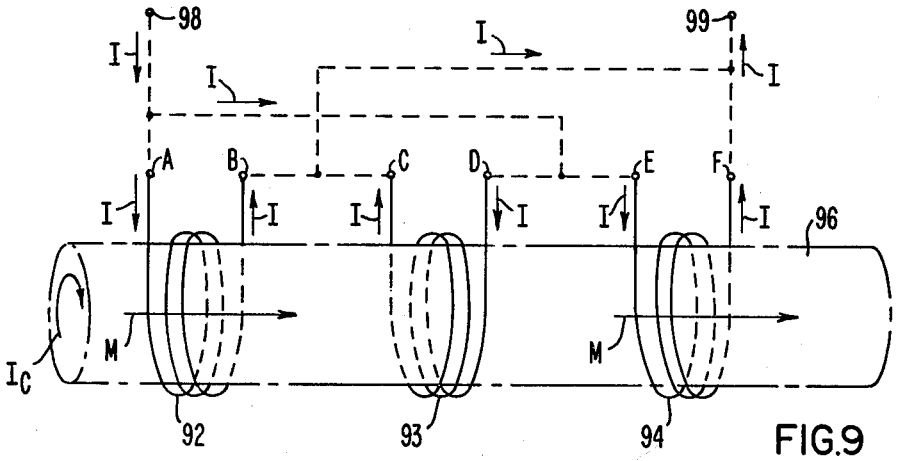
FIG. 9 illustrates the importance of the circumferential direction of module winding in a composite reactor.

As discussed above, each module can be wound in either a clockwise or a counterclockwise direction. Furthermore, it was mentioned that axially juxtaposed modules that are connected electrically in parallel should be wound oppositely from their adjacent modules. FIG. 9 illustrates the purpose of this particular winding configuration.

FIG. 9 schematically depicts three separate single-conductor modules 92, 93 and 94 arranged in an axially juxtaposed configuration. A cylinder 96 has been included in FIG. 9 in order to more clearly show the spatial relationship of the three modules and illustrate the circumferential direction of winding of each module. It should be apparent from FIG. 9 that modules 92 and 94 are wound in the same circumferential direction and that module 93 is wound in an opposite direction. It should be understood that the particular direction of winding is not important as long as adjacent modules are wound in opposite circumferential directions when axially juxtaposed and connected electrically in parallel.

Each module's conductor has two termination points and these are referenced as A, B, C, D, E and F in FIG. 9 with module 92 having terminations A and B, module 93 having terminations C and D and module 94 having terminations E and F. These termination points would, of course, correspond to the tabs shown in the other figures (e.g. reference numerals 42 and 44 of FIG. 4, reference numbers 42*a*, 42*b*, 42*c*, 44*a*, 44*b* and 44*c* of FIG. 5 and reference numerals 67*a*, 67*b*, 68*a* and 68*b* of FIG. 6). If connection points A, D and E are connected electrically together and connection points B, C and F are connected electrically together, the three modules are electrically in parallel and the composite reactor is connected electrically in series between points 98 and 99 of a transmission line.

It should be apparent that the direction of current flow, indicated by arrows I, is always flowing around the reactor in a uniform direction. For example, all three reactors 92, 93 and 94 are conducting current in the circumferential direction represented by arrow $I_c$ at the instantaneous time represented by FIG. 9. Of course, it should be understood that, over time, the direction of this alternating current flow experiences reversals at transmission line frequencies. This uniformity of current flow results in additive magnetic fields which combine to form the resultant magnetic field in the direction shown by arrow M.

Another significant reason for winding the adjacent modules in opposite circumferential directions can also be seen in FIG. 9. Adjacent connection points or tabs are at equal voltage potential. Termination points B and C are at equal potential with each other and termination points D and E are at equal potential as a result of the oppositely wound adjacent modules. This characteristic, especially in high voltage reactors, avoids the severe insulation problems that would exist if physically adjacent connection points (e.g. B and C) were at significantly different voltage potentials.

It should be understood that the configuration shown in FIG. 9 is only one of four basic configurations of the modules of the present invention which comprise the axial juxtaposition connected in parallel, the axial juxtaposition connected in series, the radial juxtaposition connected in parallel and the radial juxtaposition connected in series. These four basic configurations can, of course, be combined to form varied physical and electrical associations of modules. It should be further understood that the illustration of FIG. 9 is schematic and has been significantly simplified to illustrate the principles described above. The physical proportions and number of turns shown are only illustrative and do not represent any particular required chracteristics or limitations of the present invention.

It should be understood that when a composite reactor, made in accordance with the present invention, comprises three or more modules, the modules are not identical because of the necessity to have the same current flowing in each module. For example, if the reactor shown in FIG. 7 is intended to be a 2.65 millihenry (mH) reactor, it would be designed as described below. The five modules (e.g. 73, 74, 75, 76, and 77), axially juxtaposed and connected electrically in parallel, would be sized so that modules 73 and 77 were identical and modules 74 and 76 are identical. Modules 73 and 77 would be approximately 21.2 inches in axial length and would comprise 107 turns each. Modules 74 and 76 would be approximately 17.4 inches in axial length and would each comprise 88 turns. Module 75 would be approximately 16.9 inches in axial length and would comprise 86 turns. It should be apparent that the modules become axially longer and comprise a higher number of turns as their axial position relative to the axial center of the composite reactor increases, with the outermost modules 73 and 77 being longest and having the highest number of turns. Furthermore, the modules whose centers are the same distance from the composite reactor center are generally identical. Thus, it can be said that the composite reactor is symmetrical about its axial centerline.

The reason for these design features is the fact that the lines of flux produced by the reactor current tend to escape from the sides of the reactor. As a consequence, a turn located in module 75 will have more flux linkages than one located in module 73 and 77. It is necessary for each module of a composite reactor to conduct essentialy the same current when they are connected in parallel so that each module will have exactly the same number of flux linkages. Since some of the flux leaks from the side of the reactor, it is necessary to put more turns in the modules which are more remote from the composite reactor center.

The exemplary reactor illustrated in FIG. 7 and described above is intended to illustrate the axially symmetrical nature of an axially juxtaposed reactor made in accordance with the present invention. Its dimensions and number of turns are therefore merely illustrative and it should be understood that the concept of the present invention is not so limited.

It should be understood that when a plurality of the modules of the present invention are connected electrically in parallel, whether radially or axially juxtaposed, they must cooperate in such a way as to equally share the current load of the composite reactor. From the discussion above which concerned an axially juxtaposed reactor, it should be apparent that this current balancing characteristic requires careful and deliberate design procedures.

The current in any particular module of a composite reactor is a function of its own, or self inductance and its mutual inductance with its associated modules. Therefore, it should be understood and appreciated that modules which are physically identical will not generally behave in an electrically identical manner when connected in parallel and disposed proximate each other.

As an illustration of the many design considerations and parametric choices involved in balancing the currents in the electrically parallel modules, an eight-module radially juxtaposed composite reactor of 31.8 millihenries and 2000 amperes will be described. This hypothetical reactor has its eight modules connected electrically in parallel and would appear schematically, except for the specific number of modules, as that shown in FIG. 8. The discussion below, read in conjunction with the following tables, will illustrate the exemplary design constraints involved in achieving a general current balance among the eight modules of a radially juxtaposed composite reactor.

In both Tables 1 and 2, each module (i.e. 1 through 8) is listed along with selected values of its physical characteristics. "Radial build" represents its radial thickness (i.e. half the difference between its inside and outside diameters), "means radius" is half of the average of its inside and outside diameters, "height" is its axial length, "turns" represents the total number of circumferential conductor turns in the module, "cable length" is the required amount of cable feet required to achieve the number of turns, "% current" is the module's share of the total current load of the composite reactor and "max turns" is the total number of turns that could possibly be would in the module (i.e. the number of available rows multiplied by the number of available columns). The module numbers (i.e. 1 through 8) represent the eight modules of the reactor with module number 1 being the radially innermost module, number 8 being the radially outermost module, and so on.

TABLE 1

| Module | Radial Build | Mean Radius | Height | Turns | Cable Length | % Current | Max Turns |
|---|---|---|---|---|---|---|---|
| 1 | 4⅛" | 40⅛" | 107¼" | 225⅛ | 4737.6' | 12.69 | 234 |
| 2 | 4⅛" | 44⅞" | 77" | 164¾ | 3871.1' | 12.11 | 168 |
| 3 | 4⅛" | 49⅝" | 63¼" | 135¾ | 3527.3' | 13.06 | 138 |
| 4 | 4⅛" | 54⅜" | 57¾" | 120¾ | 3422.0' | 11.95 | 126 |
| 5 | 4⅛" | 58⅞" | 52¼" | 110¼ | 3398.7' | 12.89 | 114 |
| 6 | 4⅛" | 63⅝" | 49⅛" | 104¾ | 3489.6' | 11.88 | 108 |
| 7 | 4⅛" | 68⅜" | 49⅛" | 103½ | 3705.4' | 13.47 | 108 |
| 8 | 4⅛" | 73⅛" | 49⅛" | 106¼ | 4068.1' | 11.96 | 108 |

From an inspection of Table 1, it should be apparent that this reactor is made of eight modules which all have the same radial thickness of 4⅛". The dimension allows for three rows of turns in this example. In order to reduce the number of turns in the outer modules, a preselected number of columns are eliminated. For example, in module number 1 there are 78 columns and in module number 8 there are 36 columns, where each column comprises 3 rows. It should be noted that this design requires that there be an even number of columns in order for the cable termini to be positioned at the same radial position of the module. Of course, it should be obvious that as the number of columns are reduced the axial length, or height, of the modules is decreased with the outer modules being shorter than the inner modules. Since a perfect current balance between modules would result in 12.5% of the current flowing through each module, it can be seen that this exemplary design, although not perfect, achieves a relatively good current balance. However, the significant variation in height of the modules can possibly present two problems. First, the mechanical support of the composite reactor becomes more complex than it would be if all modules were the same height and, secondly, axially short modules cannot withstand the voltage impulse rating, or basic impulse level (BIL), that may be required of them in certain applications. Therefore, although the reactor described in Table 1 would function electrically with relatively well balanced currents, other considerations may dictate an alternate design.

Table 2 illustrates an alternative design arrived at under the same basic criteria (i.e. 31.8 millihenries, 2000 amperes and eight modules).

TABLE 2

| Module | Radial Build | Mean Radius | Height | Turns | Cable Length | % Current | Max Turns |
|---|---|---|---|---|---|---|---|
| 1 | 4⅛" | 40⅛" | 110" | 217.7 | 4573.3' | 12.52 | 240 |
| 2 | 4⅛" | 44⅞" | 110" | 180.4 | 4237.7' | 12.49 | 240 |
| 3 | 4⅛" | 49⅝" | 110" | 157.1 | 4082.8' | 12.54 | 240 |
| 4 | 4⅛" | 52¾" | 110" | 147.0 | 4061.2' | 12.41 | 240 |
| 5 | 2¾" | 58⅞" | 110" | 133.9 | 4128.5' | 12.57 | 160 |
| 6 | 2¾" | 63⅝" | 110" | 127.9 | 4260.7' | 12.48 | 160 |
| 7 | 2¾" | 68⅜" | 110" | 125.3 | 4487.5' | 12.49 | 160 |
| 8 | 2¾" | 73⅛" | 110" | 126.4 | 4838.8' | 12.50 | 160 |

It should be readily apparent that the four innermost modules are radially thicker than the four outermost modules. This is because the reactor illustrated in Table 2 employs 3 rows in modules 1–4 and 2 rows in modules 5–8. This technique permits the outer modules to be built with fewer turns while maintaining their axial length, or height, of 110". This characteristic is also made obvious by each module's maximum turns which are either 240 (i.e. 3 rows and 80 columns) or 160 (i.e. 2 rows and eighty columns).

It should be noted that the design criteria of a composite reactor made in accordance with the present invention include not only its mechanical and electrical characteristics, but also the economic efficiency of its construction. For example, module number 5 of Table 2 uses approximately 83.7% of its maximum available turns (i.e. 133.9 turns of 160 max. turns) because of the application of a 2 row module instead of the 55.8% utilization that would result with a 3 row module.

These two examples of radially juxtaposed composite reactors are discussed above to illustrate that each module of a reactor made in accordance with the present invention must be designed particularly for each application and configuration. In order to achieve well balanced currents among the modules, each module must be carefully analyzed to assure that it will cooperatively associate with the other modules to achieve this result. Consideration must be given to each module's selfinductance and mutual inductance with each other module of the proposed composite reactor. The mutual inductance between modules must be determined to be cooperating with the self-inductance of each module to result in each module having generally the same flux linkages when carrying the same current. This assures balanced currents when the modules are connected electrically in parallel.

The effect of the mutual inductances can be seen by inspection of Tables 1 and 2. In both of these hypothetical reactors, it can be seen that as the modules progress radially outward from module 1, their number of turns decreases except for the relationship between module 7 and module 8 in which module 8 has more turns in each case. This result is caused by the effects of mutual inductance between modules and the fact that module 8 has no module adjacent to its radially outer perimeter.

It should be understood that the above two examples represent only two of many possible designs of a composite reactor made in accordance with the present invention. These examples are discussed herein in order to emphasize the importance of the self and mutual inductance of the modules and their effect on the current balancing objectives of reactor design. Although the electrical equations and methods of calculations related to inductance, current and flux linkages are well known to those skilled in the art, it should be appreciated that the matrix analysis and iterative procedures involved in the solution of these interrelated variables are generally beyond the normal capabilities of one skilled in the art without the aid of a computer when composite reactors comprising many modules are involved.

It should be apparent from the Figures and the discussion above that the present invention discloses a modular reactor design that permits reactors to be manufactured that are of a higher inductance and current capacity than would be easily manufacturable under present methods. Since, as described above, the energy storage capacity of a reactor is a function of its inductance L, and its current squared $I^2$, it should further be apparent that a high energy reactor can be manufactured by producing the individual modules of the present invention and assembling them together in its field application location, thereby reducing the required physical manufacturing capacity. It further minimizes the required axial length required to provide a given inductance characteristic by winding the modules in radial columns which are alternated in their radial sequence of winding for adjacent columns. Still further, it provides a modular concept which permits the modules to be associated in either axial or radial juxtaposition and be electrically connected either in series or in parallel.

What we claim is:

1. A reactor comprising:

three or more self-supporting generally cylindrical modules of which each of said modules comprises a conductive cable helically wound in a plurality of turns about a centerline with means for supporting said turns, said turns including a number of turns in each of a plurality of planes perpendicular to said centerline, and said cable has terminal means at each end thereof;

means electrically connecting said terminal means of said modules so said cables of said modules are electrically in parallel;

said modules being radially juxtaposed concentrically about a common centerline with each having substantially the same dimensions parallel to said centerline; and said modules having varying numbers of said turns with the radially outermost of said modules having a greater number of turns than its radially inside adjacent module and each of the others of said modules that is radially inside another of said modules having a greater number of said turns than its radially outside adjacent module for substantial current balance among all of said modules.

2. A reactor in accordance with claim 1 wherein:

said modules include modules of varying dimension perpendicular to said centerline wherein at least one thinner dimensioned module is radially outside at least one thicker dimensional module.

3. A reactor comprising:

three or more self-supporting generally cylindrical modules of which each of said modules comprises a conductive cable helically wound in a plurality of turns about a centerline with means for supporting said turns, said turns including a number of turns in each of a plurality of planes perpendicular to said centerline, and said cable has terminal means at each end thereof;

means electrically connecting said terminal means of said modules so said cables of said modules are electrically in parallel;

said modules being axially juxtaposed coaxially along a common centerline with each having substantially the same dimensions perpendicular to said centerline;

said modules having varying numbers of turns with a substantially symmetrical arrangement wherein modules that are equidistant from the midpoint of said centerline each have the same number of turns and each have a larger number of turns than any others of said modules that are closer to the midpoint of said centerline for substantial current balance among all of said modules.

4. A reactor in accordance with claim 3 wherein:

axially adjacent ones of said modules have said turns wound in opposite circumferential directions; and said modules include modules of varying dimension parallel to said centerline wherein at least one axially longer module is axially outside, in relation to the midpoint of said centerline, at least one axially shorter module.

* * * * *